US012460519B2

(12) United States Patent
Lowe et al.

(10) Patent No.: US 12,460,519 B2
(45) Date of Patent: Nov. 4, 2025

(54) PERFORATING GUN HAVING MODULAR CONSTRUCTION

(71) Applicant: Schlumberger Technology Corporation, Sugar Land, TX (US)

(72) Inventors: Erick Lowe, Clamart (FR); Bhagyashri Walse, Pune (IN); Hari Prakash Kalakonda, Pune (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/834,908

(22) PCT Filed: Apr. 12, 2023

(86) PCT No.: PCT/US2023/018230
§ 371 (c)(1),
(2) Date: Jul. 31, 2024

(87) PCT Pub. No.: WO2023/200823
PCT Pub. Date: Oct. 19, 2023

(65) Prior Publication Data

US 2025/0163783 A1 May 22, 2025

(30) Foreign Application Priority Data

Apr. 12, 2022 (IN) ..... 202221021701

(51) Int. Cl.
*E21B 43/119* (2006.01)
*E21B 43/117* (2006.01)

(52) U.S. Cl.
CPC ..... *E21B 43/119* (2013.01); *E21B 43/117* (2013.01)

(58) Field of Classification Search
CPC .... E21B 43/117; E21B 43/119; E21B 43/116; E21B 43/11
See application file for complete search history.

(56) References Cited

U.S. PATENT DOCUMENTS

| | | | | |
|---|---|---|---|---|
| 11,125,056 | B2 * | 9/2021 | Parks | E21B 43/119 |
| 11,480,038 | B2 * | 10/2022 | Eitschberger | E21B 43/1185 |
| D1,019,709 | S * | 3/2024 | Eitschberger | D15/21 |
| 2019/0040722 | A1 * | 2/2019 | Yang | E21B 43/116 |
| 2019/0353013 | A1 | 11/2019 | Sokolove et al. | |
| 2019/0368319 | A1 | 12/2019 | Collins et al. | |
| 2020/0048996 | A1 | 2/2020 | Anthony et al. | |
| 2020/0318465 | A1 | 10/2020 | Von Kaenel et al. | |
| 2021/0115766 | A1 * | 4/2021 | Sokolove | E21B 43/1185 |

(Continued)

OTHER PUBLICATIONS

Search Report and Written Opinion of International Patent Application No. PCT/US2023/018230 Dated Jul. 26, 2023, 10 Pages.

*Primary Examiner* — Daniel P Stephenson
(74) *Attorney, Agent, or Firm* — Jeffrey D. Frantz

(57) ABSTRACT

A technique facilitates perforating operations. According to an embodiment, a perforating gun system utilizes a plurality of modular perforating gun sections which are readily assembled to create a perforating gun with a desired number and orientation of shaped charge holders. In some applications, the modular perforating gun sections may be formed of plastic, e.g. injection moldable plastic, to further reduce costs and provide great flexibility with respect to construction of the desired perforating gun.

19 Claims, 16 Drawing Sheets

(56) References Cited

U.S. PATENT DOCUMENTS

| | | | | |
|---|---|---|---|---|
| 2021/0172298 | A1 | 6/2021 | Knight et al. | |
| 2021/0277752 | A1 | 9/2021 | Eitschberger | |
| 2022/0074289 | A1 | 3/2022 | Lopez de Cardenas et al. | |
| 2023/0035484 | A1* | 2/2023 | Bradley | E21B 43/1185 |
| 2023/0203923 | A1* | 6/2023 | Eitschberger | E21B 43/119 166/297 |
| 2024/0076965 | A1* | 3/2024 | Loehken | E21B 43/119 |
| 2024/0125213 | A1* | 4/2024 | Qu | E21B 43/1185 |
| 2024/0183252 | A1* | 6/2024 | Sullivan | E21B 43/117 |
| 2025/0043664 | A1* | 2/2025 | MacGillivray | E21B 43/1185 |
| 2025/0163783 | A1* | 5/2025 | Lowe | E21B 43/119 |

* cited by examiner

PERFORATING GUN HAVING MODULAR CONSTRUCTION

CROSS-REFERENCE TO RELATED APPLICATION

This application is a national stage entry of PCT Application No. PCT/US2023/018230, filed Apr. 12, 2023, which claims priority to and benefit of Indian Provisional Patent Application No. 202221021701, entitled "Perforating Gun Having Modular Construction", filed on Apr. 12, 2022.

TECHNICAL FIELD

This disclosure relates to systems and methods for assembling a perforating gun using modular sections.

BACKGROUND

This section provides background information to facilitate a better understanding of the various aspects of the disclosure. It should be understood that the statements in this section of this document are to be read in this light, and not as admissions of prior art.

In many well applications, a wellbore is drilled and lined with casing. Subsequently, a perforating gun is deployed downhole to a desired location. The perforating gun has shaped charges which are ignited to create perforations through the surrounding casing and out into the formation. The perforations facilitate the flow of hydrocarbons, e.g. oil and gas, from the formation and into the wellbore for production to the surface. In fracking operations, the perforations may further be used to facilitate fracturing of the surrounding formation to enhance flow of hydrocarbons to the wellbore. Sometimes it is advantageous to create a relatively large number of perforations to enable a more thorough fracturing of the formation. However, the use of available perforating guns in creating the large number of perforations can add substantial expense to the overall operation.

SUMMARY

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, embodiments may encompass a variety of forms that may be similar to or different from the embodiments set forth below.

In general, a system and methodology facilitate perforating operations. According to an embodiment, a perforating gun system utilizes a plurality of modular perforating gun sections which are readily assembled to create a perforating gun with desired numbers and orientations of shaped charge holders. In some applications, the modular perforating gun sections may be formed of plastic, e.g. injection moldable plastic, to further reduce costs and provide great flexibility with respect to construction of the desired perforating gun. According to an embodiment, a perforating gun includes modular perforating gun sections that may be snapped together to establish a desired length of the perforating gun. Each perforating gun section has at least one charge holder and charge retainer to receive and retain a corresponding shaped charge. According to an embodiment, a method for deploying a perforating gun in a well includes assembling the perforating gun from modular perforating gun sections. A respective section snaps together with a corresponding additional section to establish a desired length of the perforating gun. Additionally, each section has at least one charge holder and charge retainer to receive and retain a corresponding shaped charge. The method also includes deploying the perforating gun downhole in the well using a conveyance.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
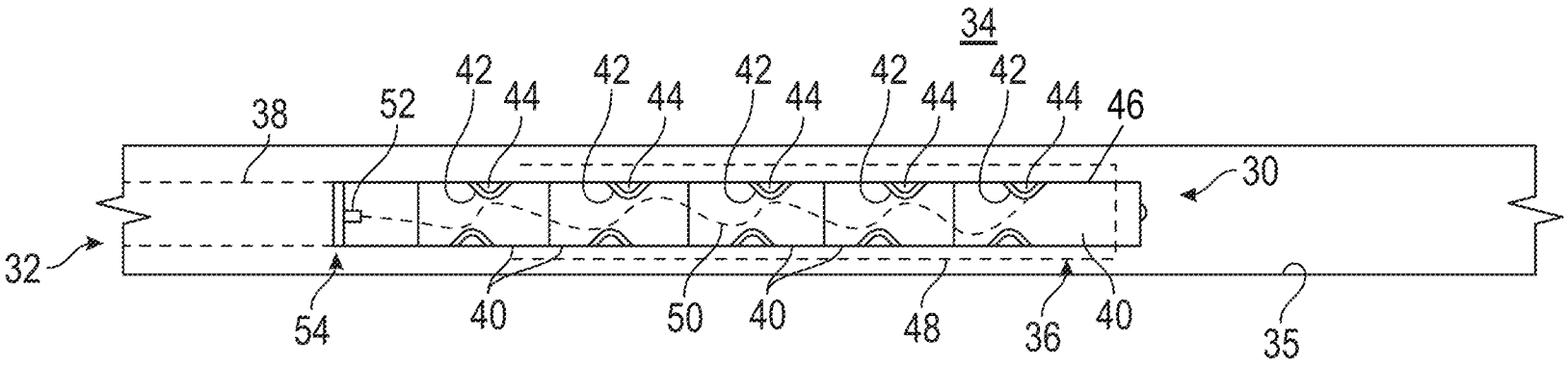
FIG. 1 is a schematic illustration of an example of a modular perforating gun system for use in a borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

At the outset, it should be noted that in the development of any such actual embodiment, numerous implementation—specific decisions are made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. The term about should be understood as any amount or range within 10% of the recited amount or range (for example, a range from about 1 to about 10 encompasses a range from 0.9 to 11). Also, in the summary and this detailed description, it should be understood that a concentration range listed or described as being useful, suitable, or the like, is intended that any concentration within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, even if specific data points within the range, or even no data points within the range, are explicitly identified or refer to a few specific, it is to be understood that inventors appreciate and understand that any data points within the range are to be considered to have been specified, and that inventors possessed knowledge of the entire range and the points within the range.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

As used herein, "embodiments" refers to non-limiting examples disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program comprises instructions causing the computer to execute one or more of the operations, or to issue commands to other devices to execute one or more of the operations.

The disclosure herein generally involves a system and methodology which facilitate perforating operations. According to an embodiment, a perforating gun system utilizes a plurality of modular perforating gun sections which are readily assembled to create a perforating gun with desired numbers and orientations of shaped charge holders. For example, different numbers of modular perforating gun sections may be assembled, e.g. snap together, to create an overall modular perforating gun of a desired length with a desired number of shaped charges. In some embodiments, individual modular perforating gun sections may be selected according to the angular orientation of the shaped charge holders so as to create perforations out into the surrounding formation with desired orientations. The modular sections also may be constructed to enable selective adjustment in the angular orientation of the shaped charge holders.

In some applications, the modular perforating gun sections may be formed of plastic, e.g. injection moldable plastic, to further reduce costs and to provide great flexibility with respect to construction of the desired perforating gun. By way of example, the plastic modular sections may be constructed as modular sections of a perforating gun loading tube. The loading tube may be selectively assembled to quickly and inexpensively construct a perforating gun with a desired configuration. According to an embodiment, the modular perforating gun sections are injection moldable and easily snapped together in a manner which prevents unwanted separation. The plastic, modular perforating gun sections also may be constructed to have angular adjustability, thus alleviating the need for construction of separate parts to achieve different orientations/phasings with respect to shaped charge arrangement.

Referring generally to FIG. 1, an example of a perforating gun system 30 is illustrated as deployed in a borehole 32, e.g. a wellbore, drilled into a formation 34. The wellbore or borehole 32 may be cased with a casing 35. Additionally, the perforating gun system 30 comprises at least one perforating gun 36 deployed downhole via a suitable conveyance 38. The illustrated perforating gun 36 comprises a plurality of modular perforating gun sections 40 which may be readily assembled to construct perforating gun 36 in a desired configuration, e.g. with a desired length and desired shaped charge phasing. In this example, each perforating gun module 40 comprises at least one shaped charge holder 42, e.g. a plurality of shaped charge holders 42, sized to receive an appropriate shaped charge 44.

In some embodiments, the modular perforating gun sections 40 are constructed as modular sections of a loading tube 46. The perforating gun 36 may comprise loading tube 46 positioned within a surrounding tubular member 48 in some applications. However, the modular perforating gun sections 40 may be used in a variety of perforating gun types with or without the surrounding tubular member 48.

The perforating gun 36 also may comprise a variety of other features such as detonator cord 50 routed to each of the shaped charges 44. A detonator 52 may be used to control ignition of the detonator cord 50 and thus ignition of the shaped charges 44. Depending on the perforating operation, perforating gun 36 may comprise various other features and components, such as an electric switch or switches for activating the detonator 52, electrical wire for power and telemetry, and a connector 54 for coupling the perforating gun 36 with conveyance 38.

Figure 2:
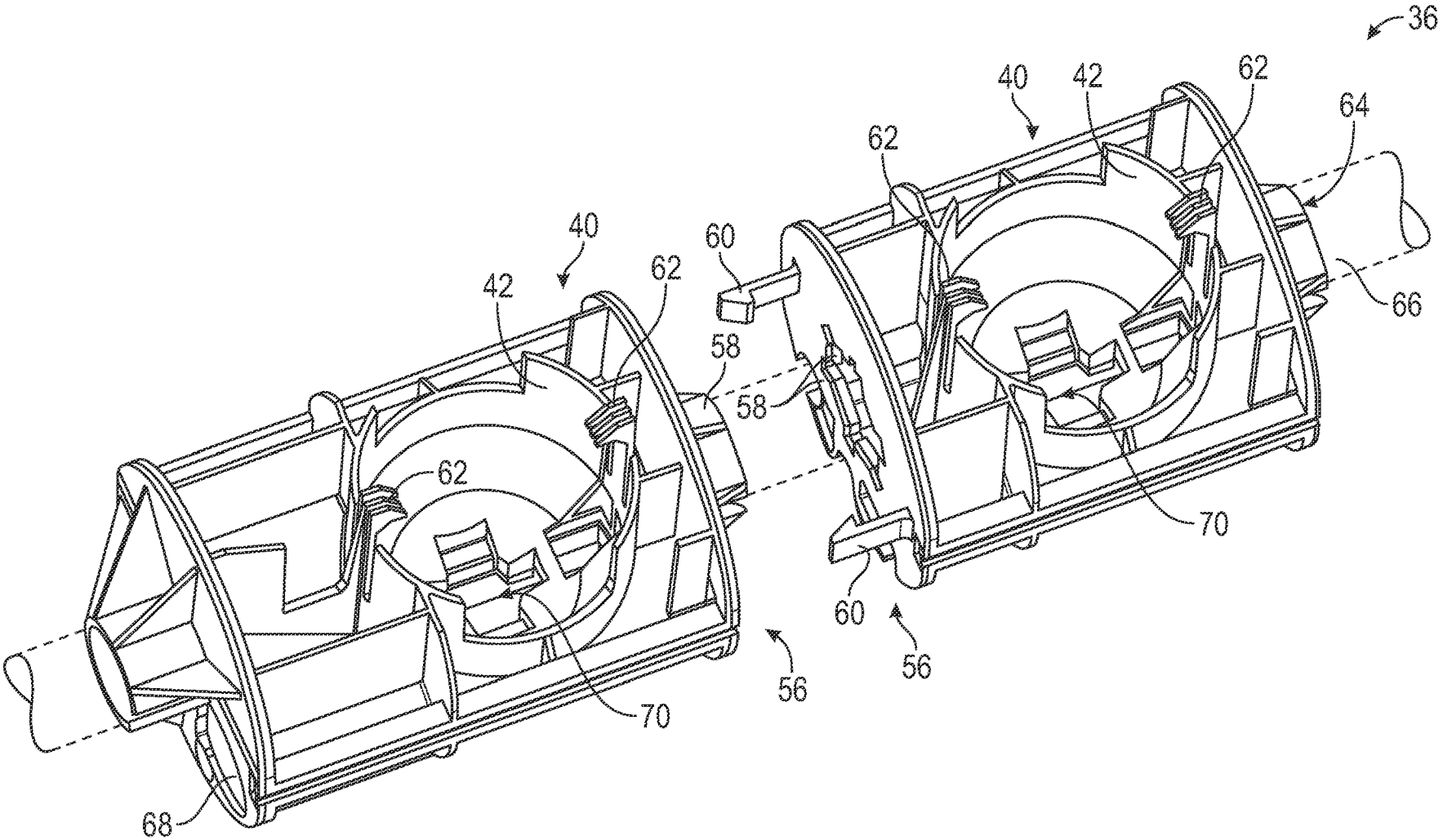
FIG. 2 is an illustration of an example of perforating gun modules which may be selectively combined, according to an embodiment of the disclosure.

Referring generally to FIG. 2, an example of modular perforating gun sections 40 is illustrated. In this example, two modular perforating gun sections 40 have been illustrated to facilitate description of the embodiment. However, additional modular perforating gun sections 40 may be added to create the desired configuration/length of perforating gun 36.

According to the embodiment illustrated in FIG. 2, each modular perforating gun section 40 has been injection molded from injection moldable plastic. Additionally, each moldable perforating gun section 40 has been formed with connection features 56 to enable easy, snap connection of adjacent perforating gun sections 40 while preventing unwanted separation after connection. In this example, moldable perforating gun sections 40 may be snapped together without the use of tools.

Figure 3:
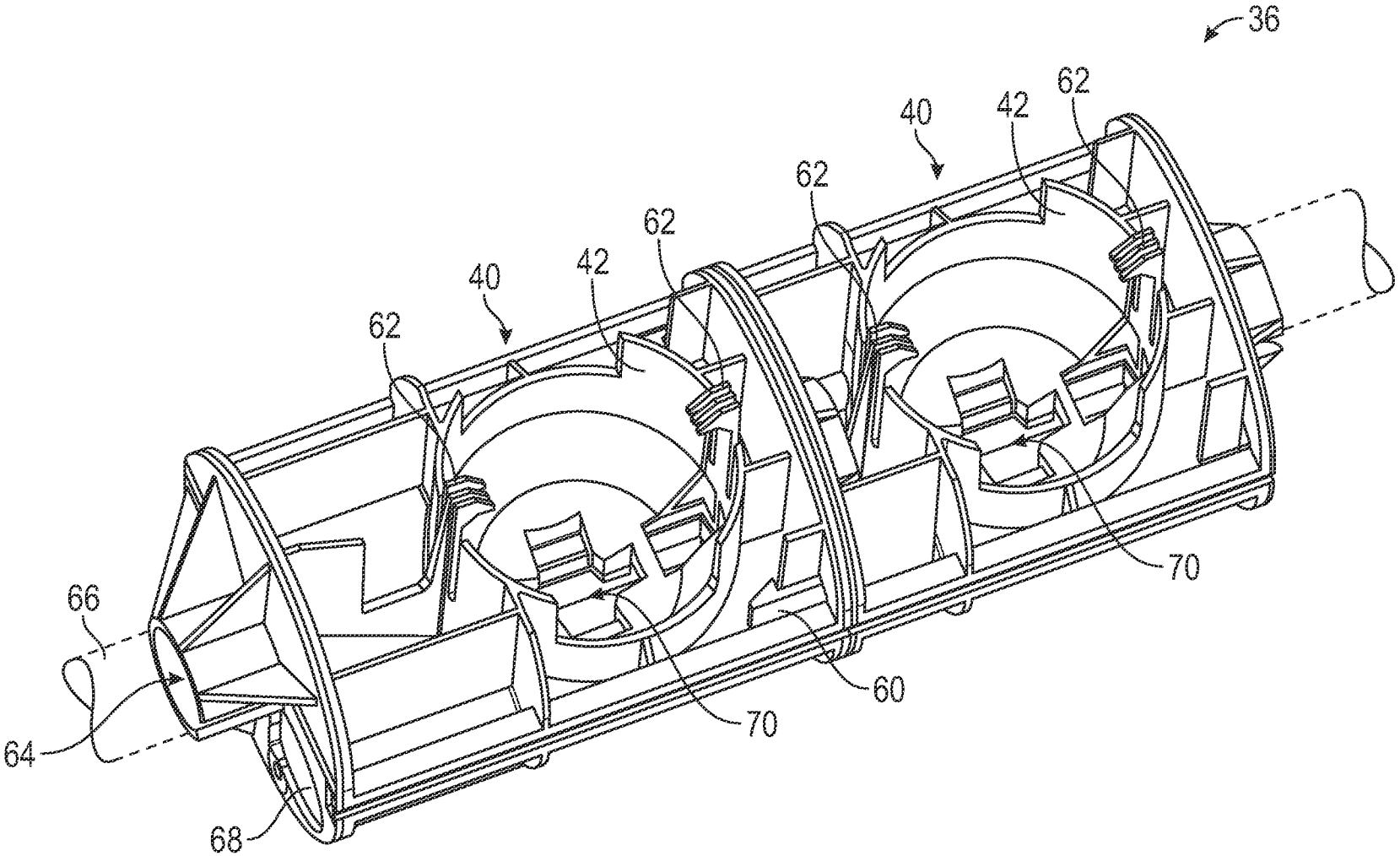
FIG. 3 is an illustration of the perforating gun modules of FIG. 2 after combination, according to an embodiment of the disclosure.

As illustrated, the connection features 56 comprise a center connection feature 58 having corresponding ribs and slots to control the angular orientation of one modular perforating gun section 40 with respect to the adjacent perforating gun section 40. The connection features 56 may also comprise snap connectors 60 each having a flexible hook which may be inserted into a corresponding opening and engaged to secure the adjacent perforating gun sections 40 to each other, as illustrated in FIG. 3. Each modular perforating gun section 40 may also comprise one or more shaped charge holders 42 combined with flexible retention members 62 arranged to secure the shaped charge 44 once inserted into a corresponding charge holder 42.

In some embodiments, the perforating gun sections 40 also include a central passage 64 through which a rod member 66 may be inserted. This allows the use of a weight 68 (or other type of weighted section) to orient the perforating gun sections 40 and thus the shaped charges 44 via gravity. In other words, the connected, modular perforating gun sections 40 are rotated about rod member 66 under the influence of gravity on weight 68. The perforating gun sections 40 also may comprise other features to accommodate sensors, electrical wires, and other components used in a given perforating operation. For example, the perforating gun sections 40 may comprise slots/passages 70 along which detonator cord 50 may be routed to corresponding shaped charges 44.

Figure 4:
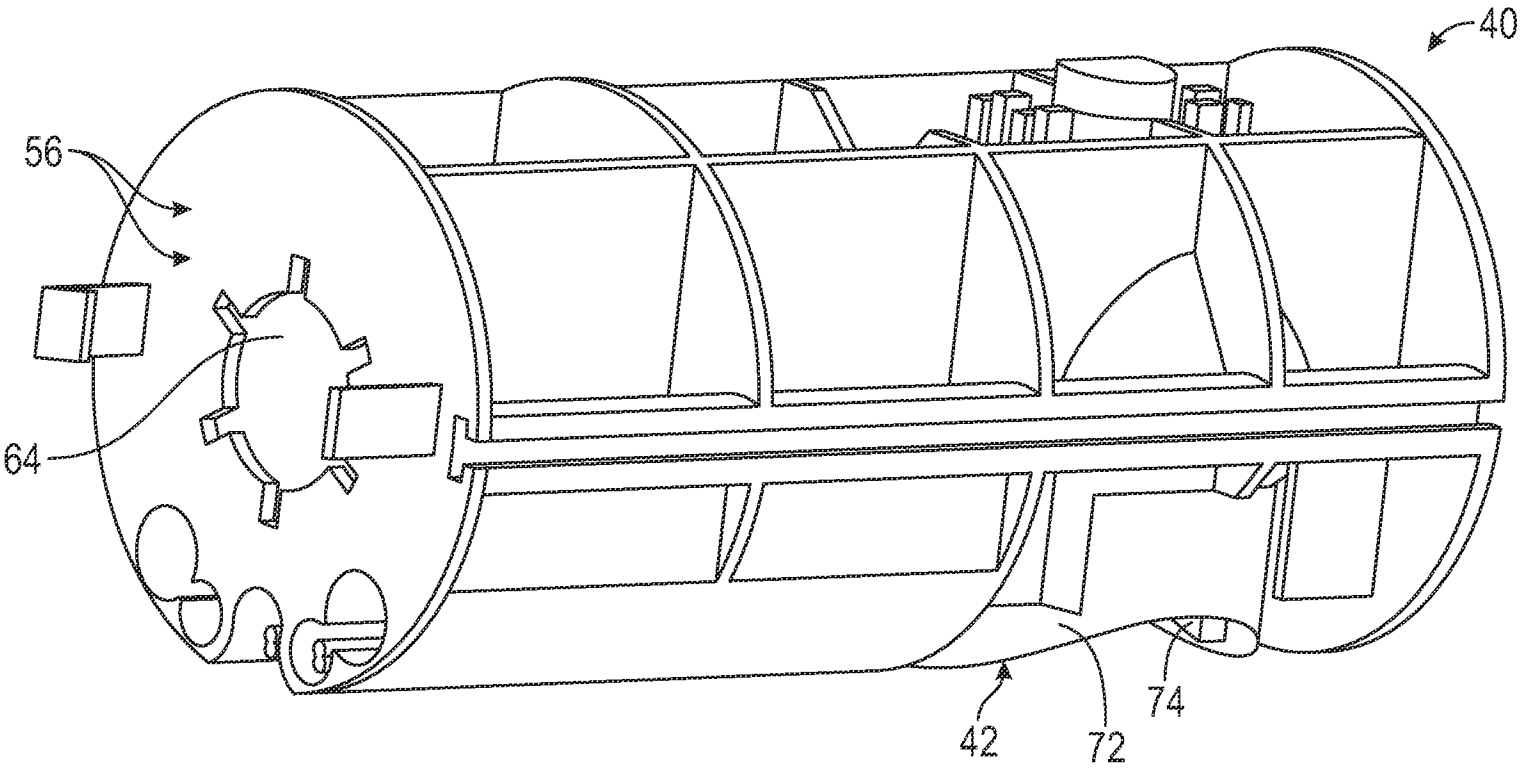
FIG. 4 is an illustration of another example of a perforating gun module which may be selectively combined with other perforating gun modules, according to an embodiment of the disclosure.
Figure 5:
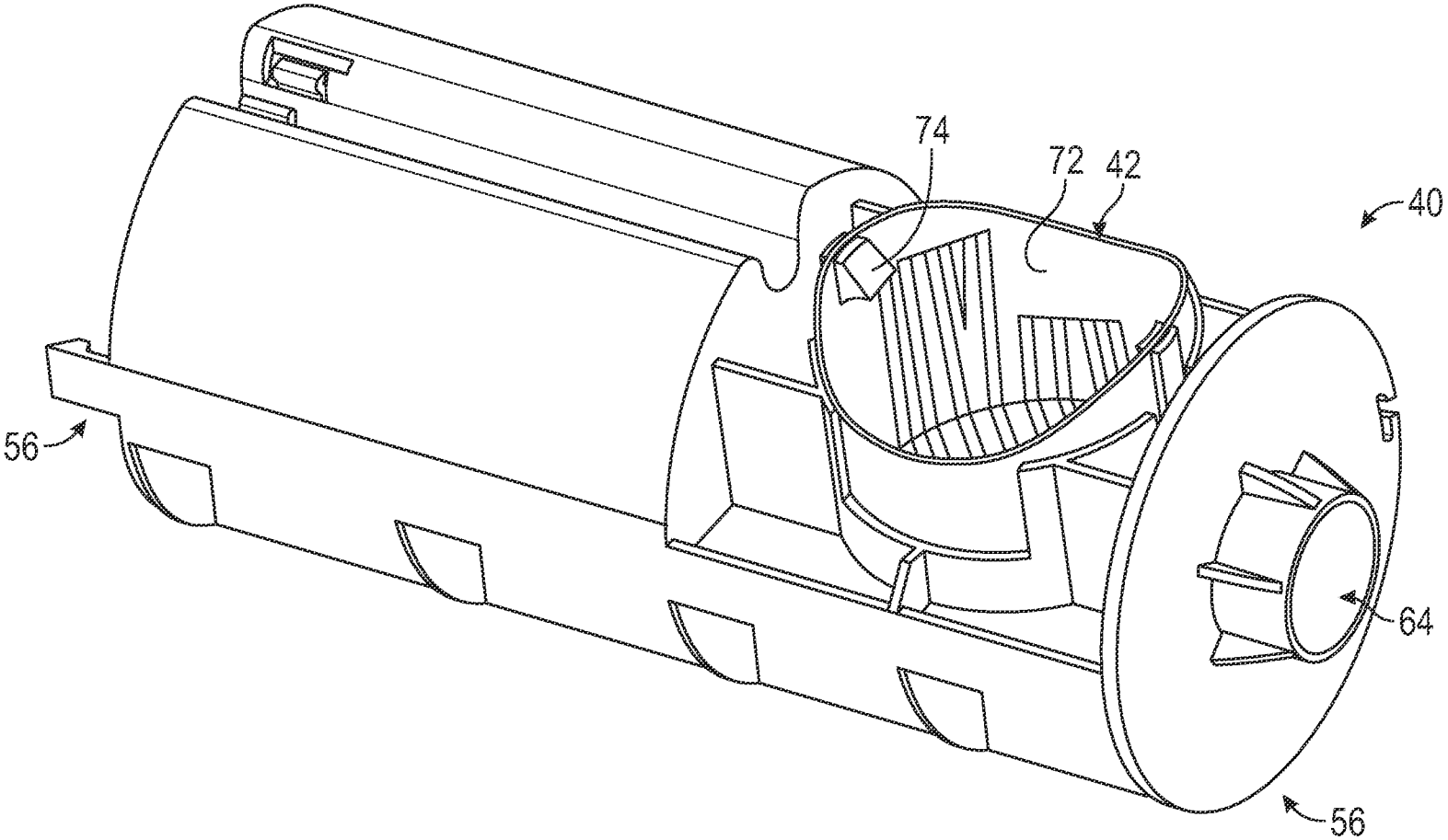
FIG. 5 is an illustration of a perforating gun module which may be snap connected with the associated perforating gun module of FIG. 4, according to an embodiment of the disclosure.

Referring generally to FIGS. 4 and 5, another embodiment of modular perforating gun sections 40 is illustrated. This embodiment has features similar to the embodiment described above with reference to FIGS. 2 and 3. However, in the latter embodiment each modular perforating gun section 40 comprises a single charge holder 42 and the connection features 56 are arranged so that the shaped charges 44 alternate 180° from one perforating gun section 40 to the next. In this example, each charge holder 42 is formed with a releasable charge holder sleeve 72 which may be releasably held in place via releasable retention features 74.

Figure 6:
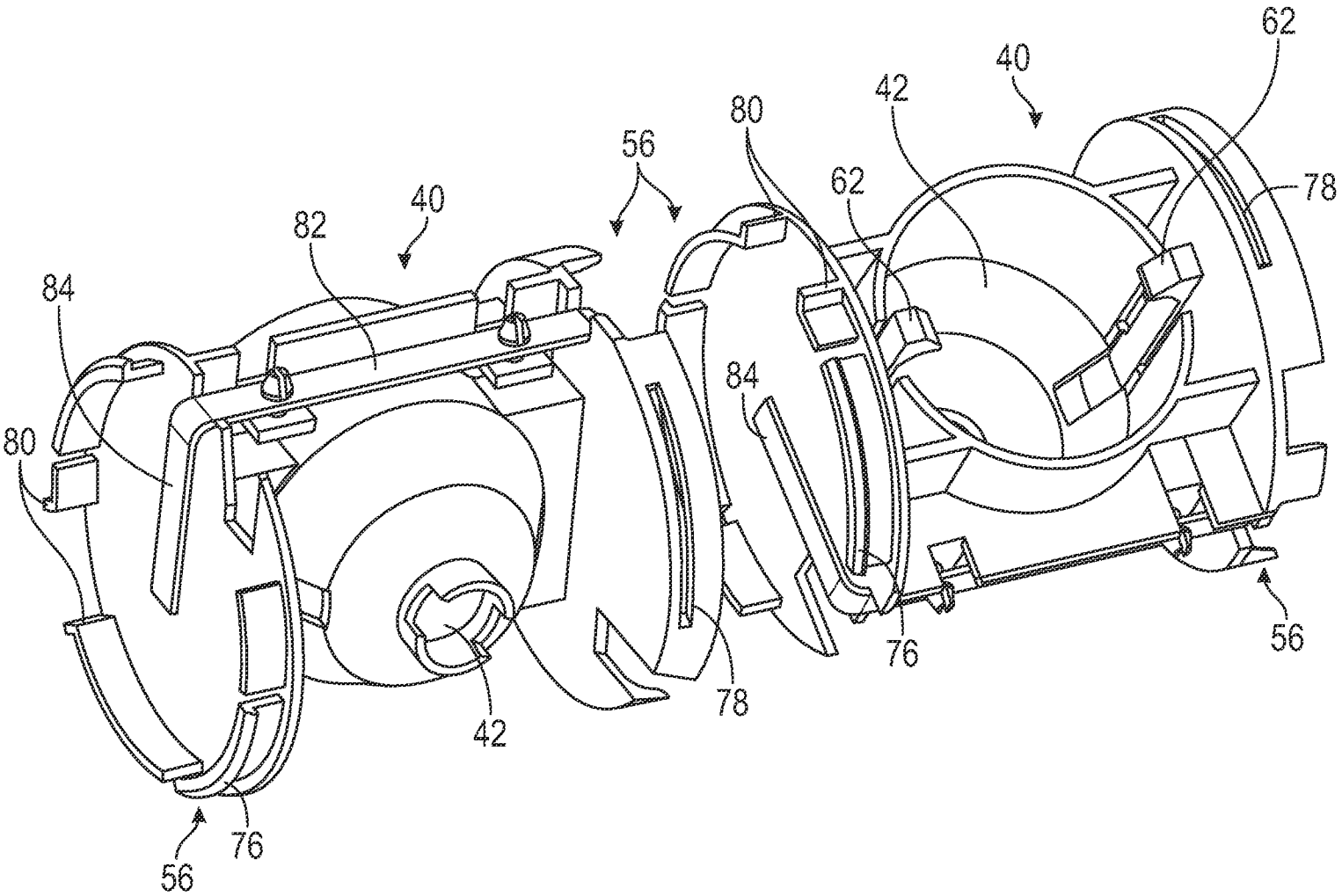
FIG. 6 is an illustration of another example of perforating gun modules which may be selectively combined, according to an embodiment of the disclosure.
Figure 7:
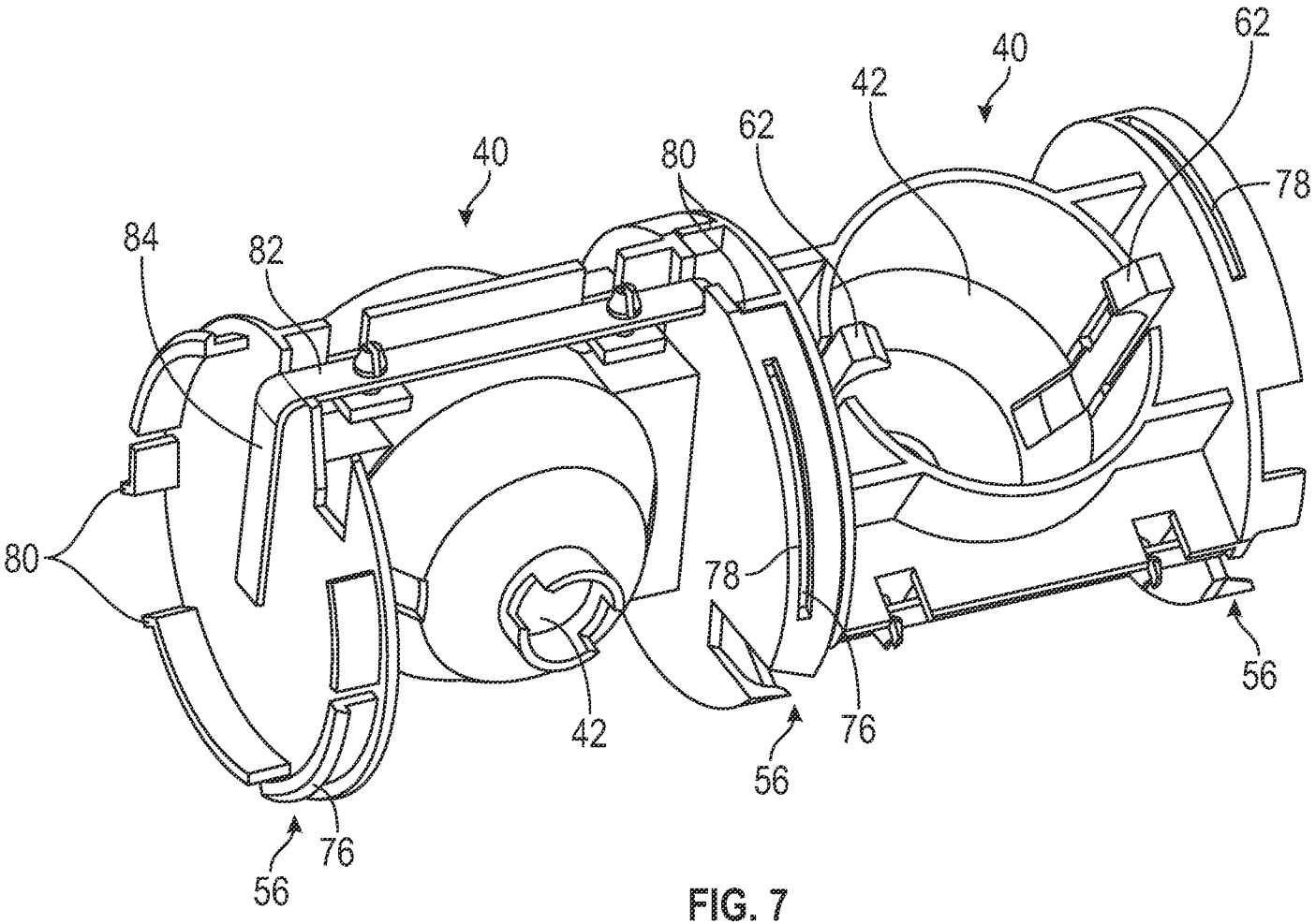
FIG. 7 is an illustration of the perforating gun modules of FIG. 6 after combination, according to an embodiment of the disclosure.

Referring generally to FIGS. 6 and 7, another embodiment of modular perforating gun sections 40 is illustrated. This embodiment has features similar to the embodiment described above with reference to FIGS. 2 and 3. However, in the latter embodiment each modular perforating gun section 40 comprises unique connection features 56 which allow sequential perforating gun sections 40 to be snapped together while maintaining the charge holders 42, and thus the shaped charges 44, at desired angular displacements with respect to each other. For example, each successive perforating gun section 40 may provide an additional 60° (or other selected angular displacement) with respect to the adjacent perforating gun sections 40. The detonator cord 50 may be wrapped helically along the overall perforating gun 36 to ensure connection with the shaped charges 44.

In this example, the connection features comprise a spring hook 76 received in a corresponding slot 78 combined with orientation tabs 80 to ensure easy, secure, and properly oriented connection of sequential, modular perforating gun sections 40. As illustrated, each perforating gun section 40 also may comprise a conductive bracket 82 having a bracket tab 84 extending radially inward to a central location to ensure conductive contact with a corresponding bracket tab 84/bracket 82 of the next sequential perforating gun section 40. The contacting conductive brackets 82 provide a conductive pathway to enable transfer of signals and/or power along the overall perforating gun 36.

Figure 8:
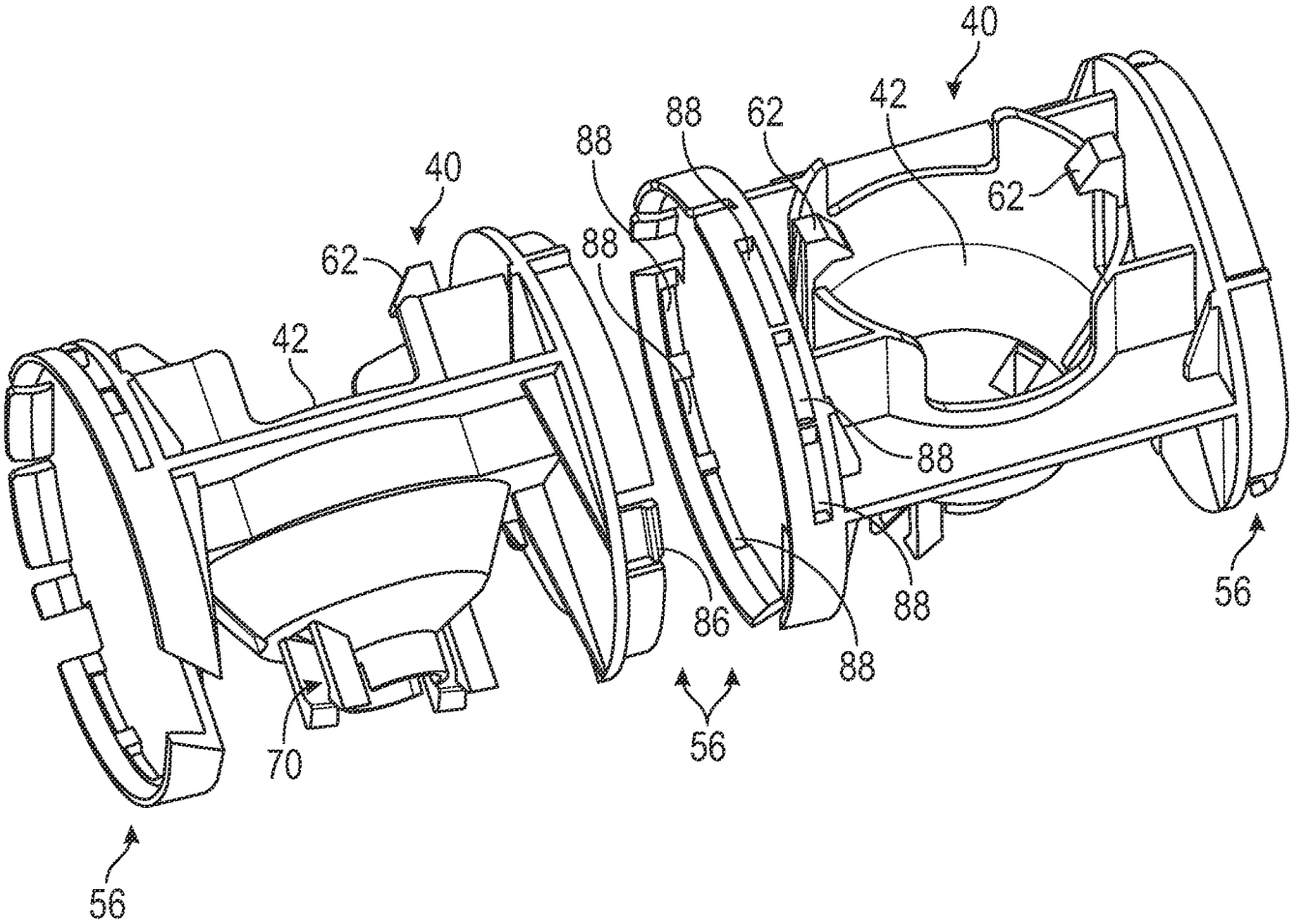
FIG. 8 is an illustration of another example of perforating gun modules which may be selectively combined, according to an embodiment of the disclosure.
Figure 9:
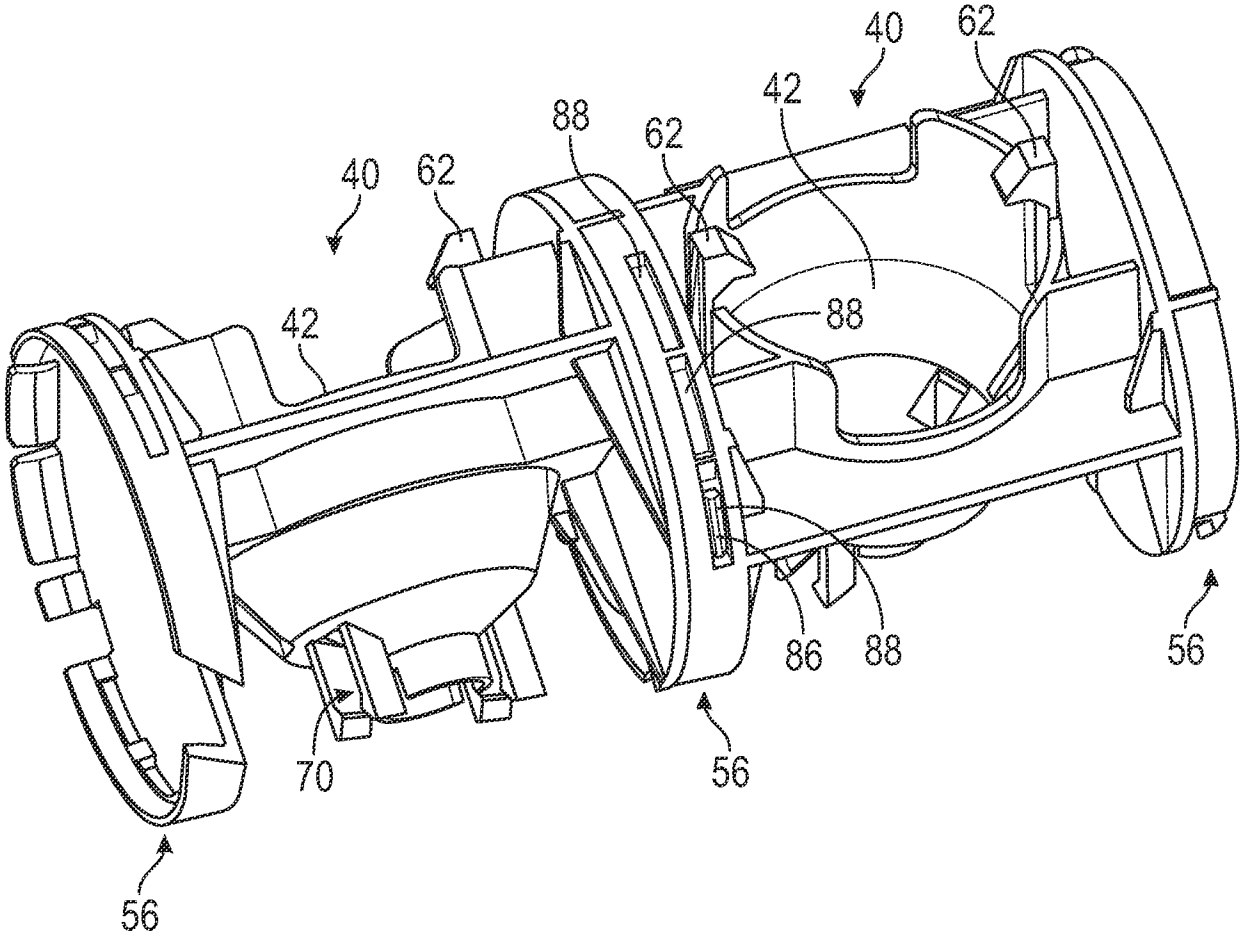
FIG. 9 is an illustration of the perforating gun modules of FIG. 8 after combination, according to an embodiment of the disclosure.

Referring generally to FIGS. 8 and 9, another embodiment of modular perforating gun sections 40 is illustrated. This embodiment has features similar to the embodiment described above with reference to FIGS. 6 and 7. However, in the latter embodiment each modular perforating gun section 40 comprises unique connection features 56 which allow adjustment of the angular orientation or phasing of each perforating gun section 40 relative to the next adjacent perforating gun section 40. For example, the connection features 56 may comprise spring tabs 86 which may be snapped into different recesses 88 located at different angular positions. As a result, the angular orientation of sequential charge holders 42/shaped charges 44 has substantial adjustability.

Figure 10:
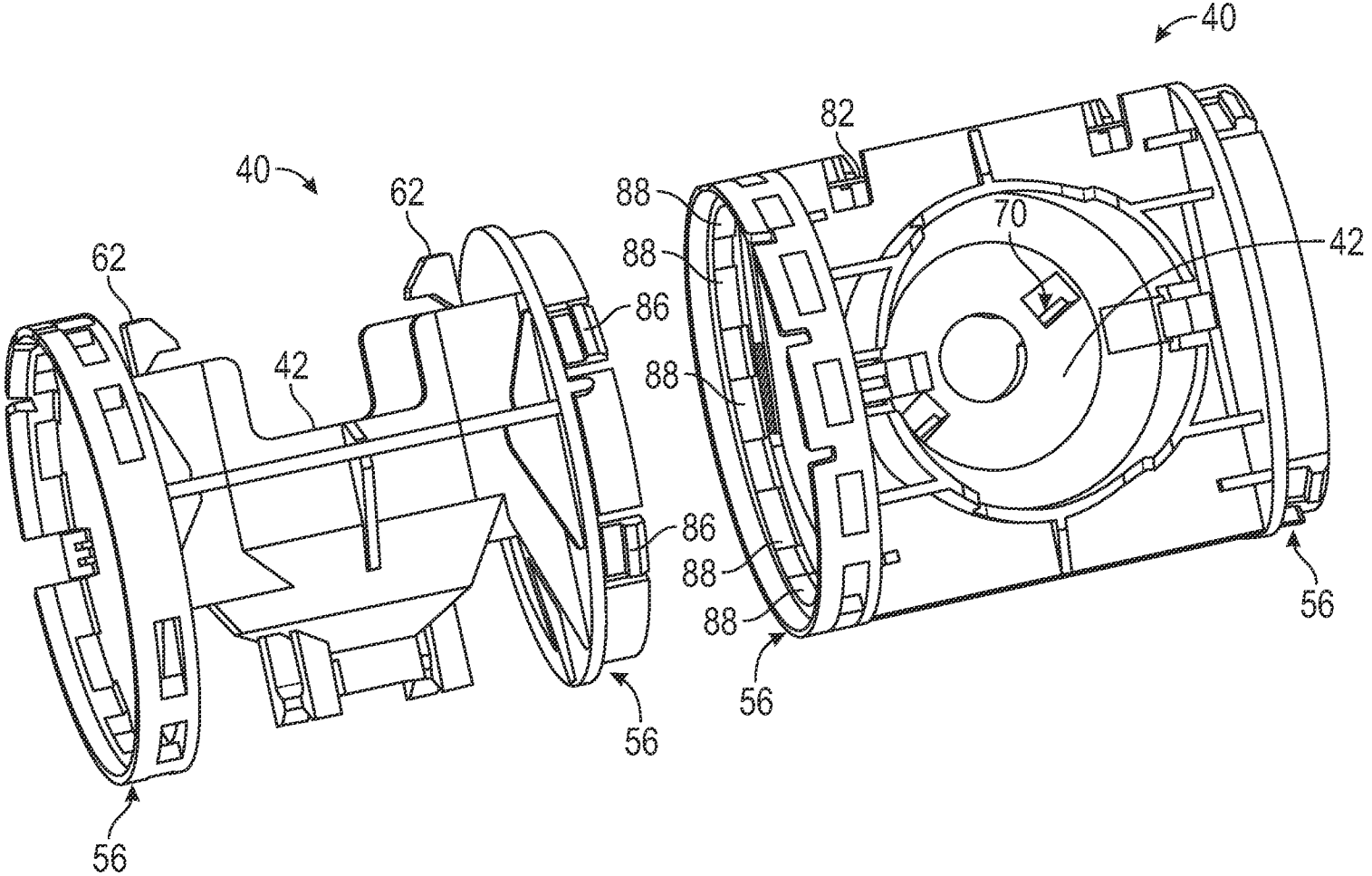
FIG. 10 is an illustration of another example of perforating gun modules which may be selectively combined, according to an embodiment of the disclosure.
Figure 11:
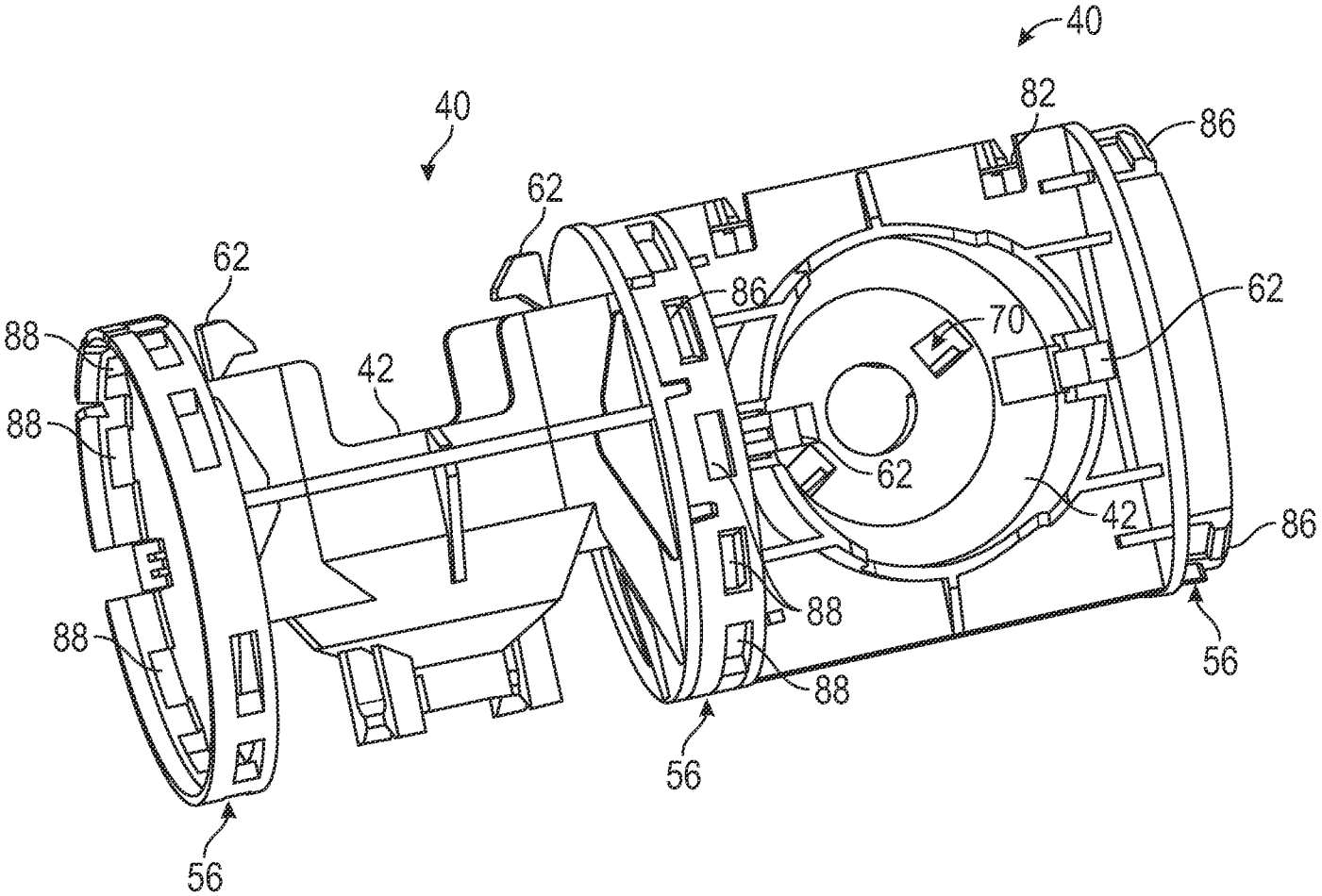
FIG. 11 is an illustration of the perforating gun modules of FIG. 10 after combination, according to an embodiment of the disclosure.

Referring generally to FIGS. 10 and 11, another embodiment of modular perforating gun sections 40 is illustrated. This embodiment has features similar to the embodiment described above with reference to FIGS. 8 and 9. However, in the latter embodiment the unique connection features 56 allow even greater adjustment of the angular orientation or phasing of each perforating gun section 40 relative to the next adjacent perforating gun section 40. For example, the connection features 56 may again comprise spring tabs 86 which may be snapped into numerous different recesses 88 located at different angular positions about the circumference of each perforating gun section 40. As a result, the angular orientation of sequential charge holders 42/shaped charges 44 has substantial adjustability. This embodiment and various other embodiments described herein may utilize conductive brackets 82 or other types of conductors to enable transmission of signals and power along the perforating gun 36.

Figure 12:
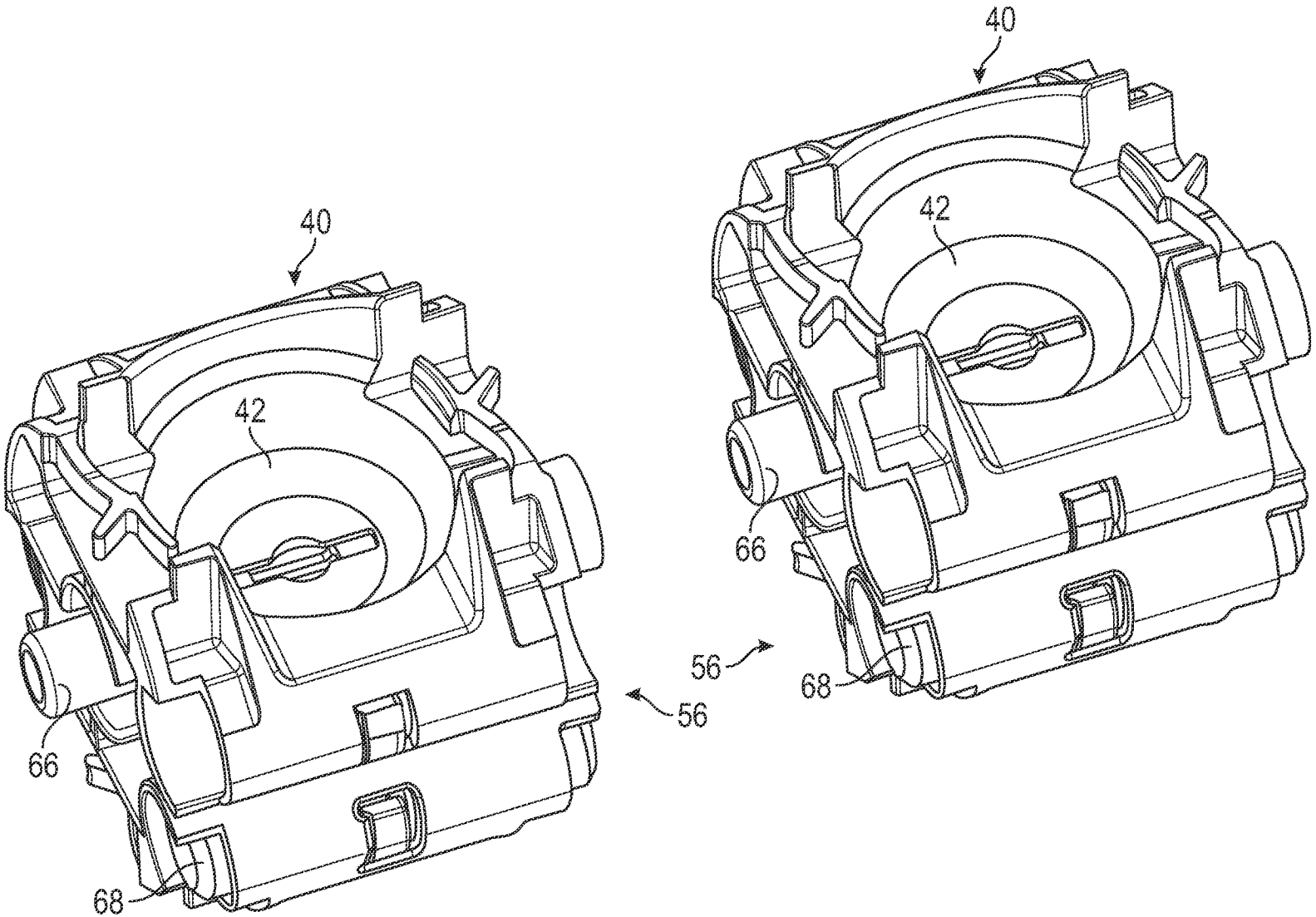
FIG. 12 is an illustration of another example of perforating gun modules which may be selectively combined, according to an embodiment of the disclosure.
Figure 13:
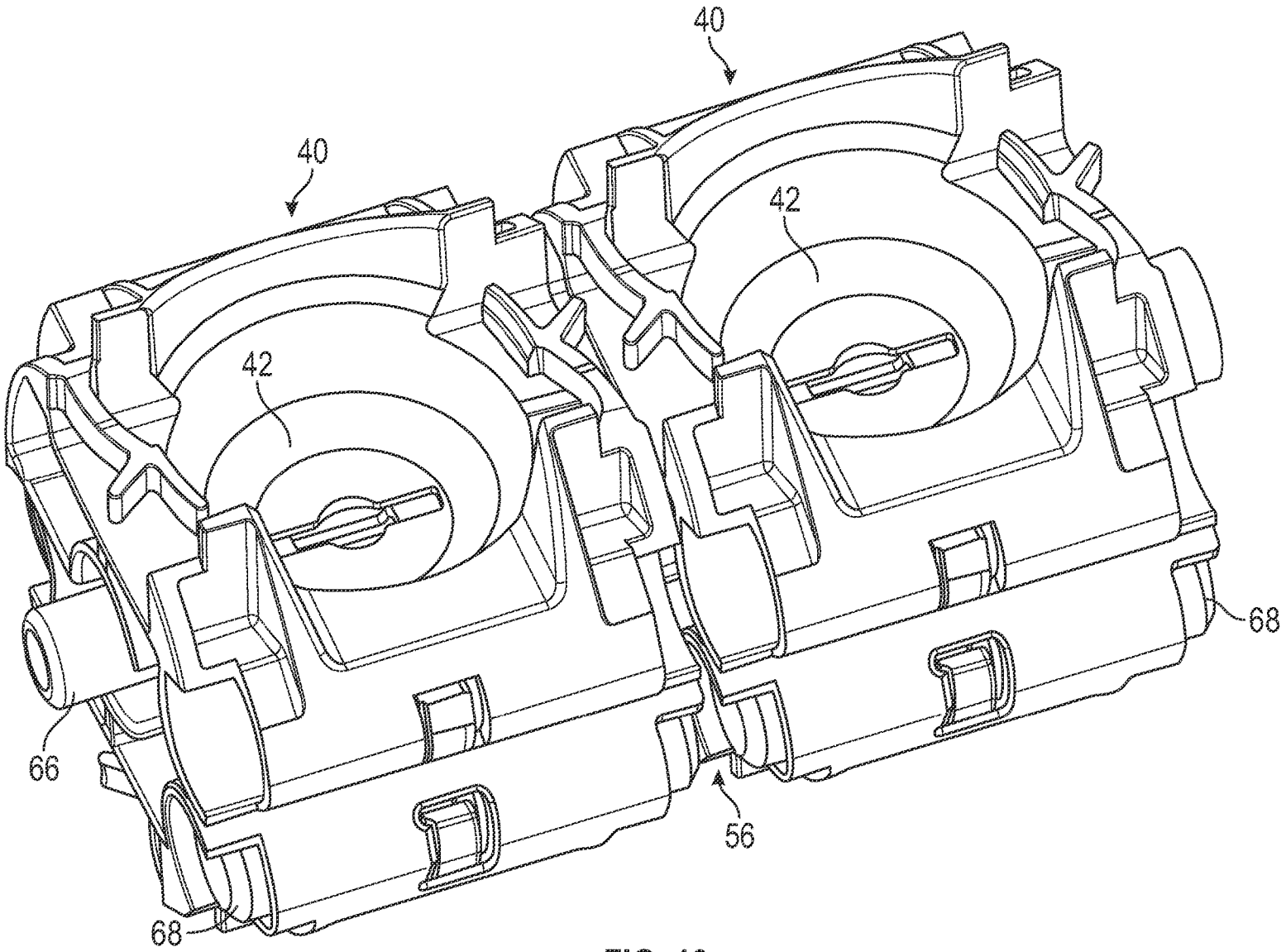
FIG. 13 is an illustration of the perforating gun modules of FIG. 12 after combination, according to an embodiment of the disclosure.

Referring generally to FIGS. 12 and 13, another embodiment of modular perforating gun sections 40 is illustrated. Similar to the other embodiments described herein, the modular perforating gun sections 40 may be formed of injection moldable plastic via a rapid, inexpensive injection molding process. The injection moldable perforating gun sections 40 enable a quick, inexpensive technique for constructing perforating gun 36 with a desired length/configuration. In this latter example, the charge holders 42 are arranged in each perforating gun section 40 so that at least some sequential shaped charges 44 are positioned in the same plane. In this example, weights 68 may again be used to pivot the modular perforating gun sections 40 about a rod member 66. Various types of connection features may be used to provide interlocking of adjacent perforating gun sections 40.

Figure 15:
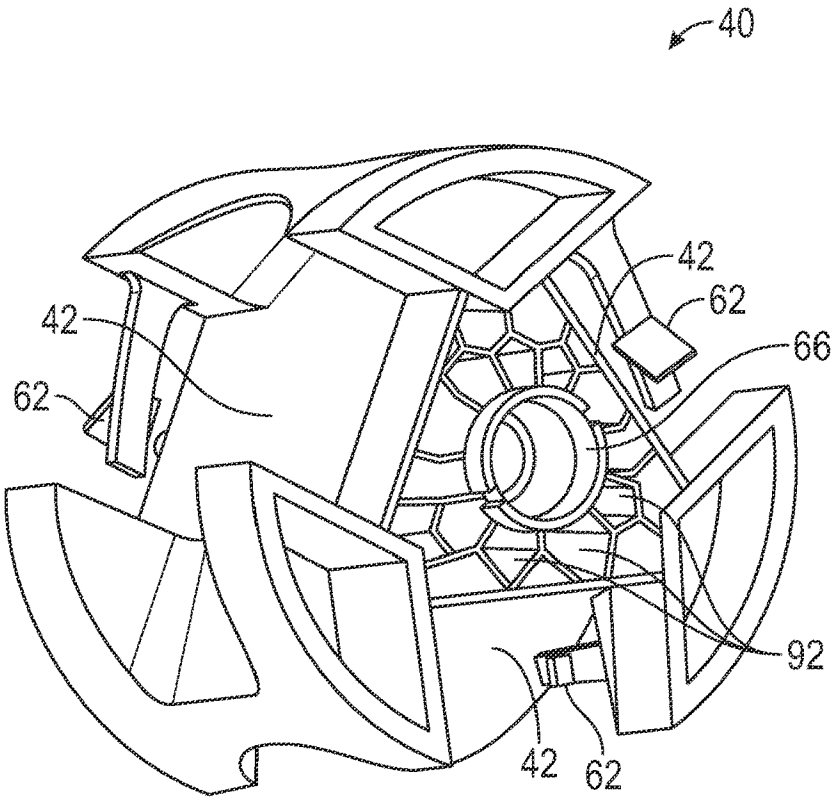
FIG. 15 is an illustration of the perforating gun module of FIG. 14 from a different angle, according to an embodiment of the disclosure.
Figure 14:
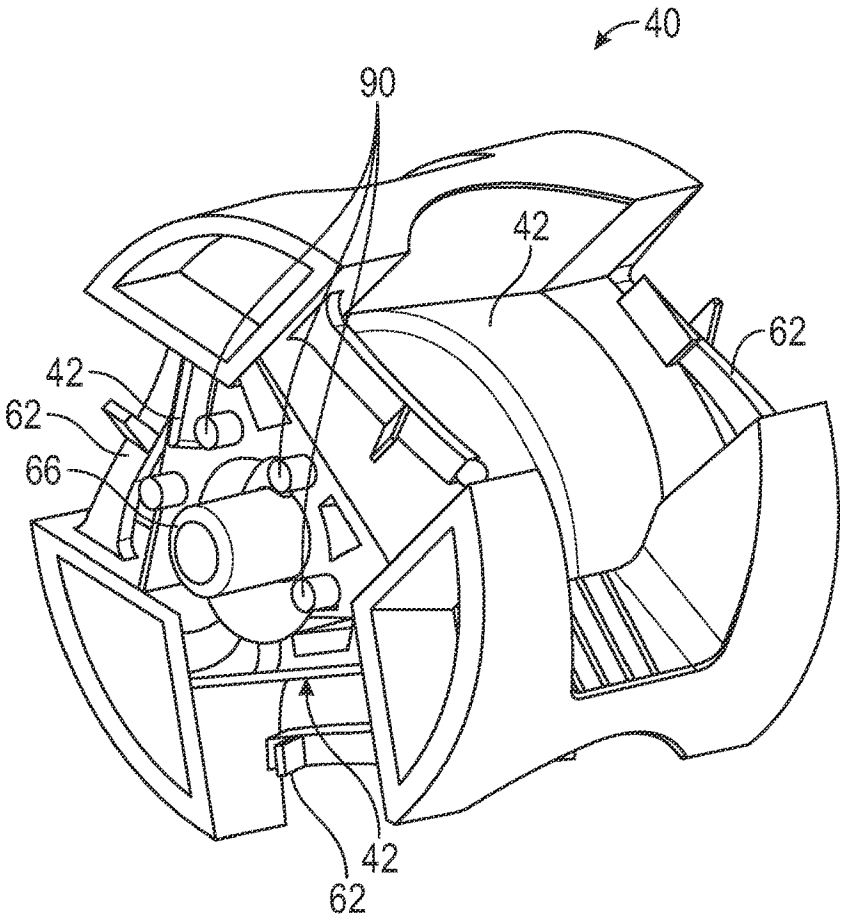
FIG. 14 is an illustration of another example of a perforating gun module which may be selectively combined, according to an embodiment of the disclosure.

Referring generally to FIGS. 14 and 15, another embodiment of modular perforating gun sections 40 is illustrated. In this example, the connection features 56 may comprise a series of pins 90 received in corresponding pin recesses 92 to control angular orientation of one perforating gun section 40 relative to the adjacent perforating gun sections 40. A central rod member 66 may be used to facilitate positioning and orientation of the charge holders 42. For example, adjacent perforating gun sections 40 may be arranged to orient multiple charge holders 42 and the shaped charges 44 in a common plane.

Figure 17:
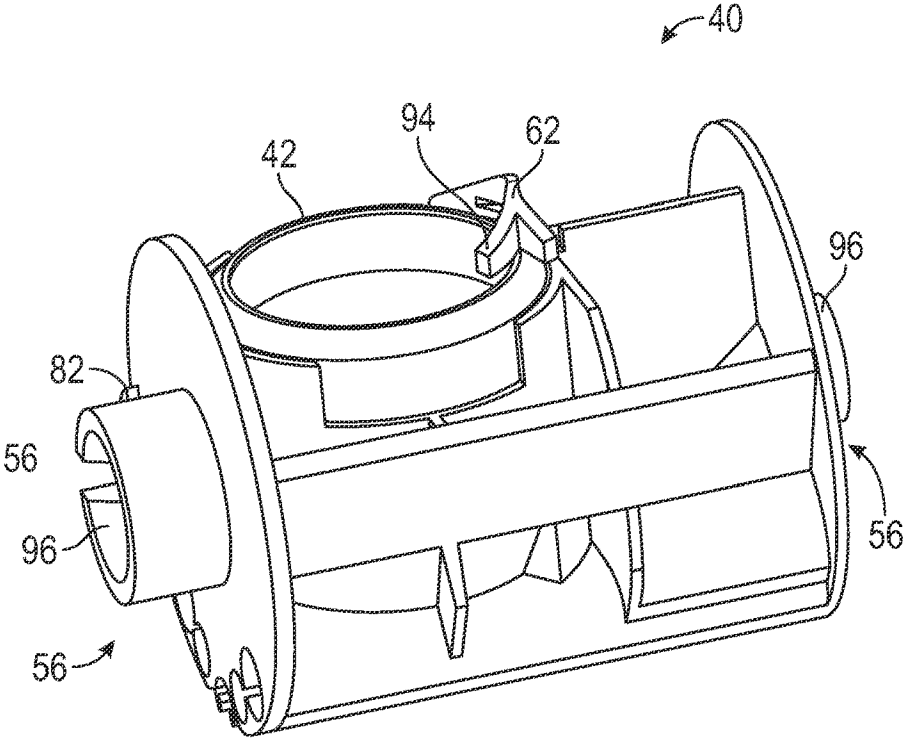
FIG. 17 is an illustration of the perforating gun module of FIG. 16 from a different angle, according to an embodiment of the disclosure.
Figure 16:
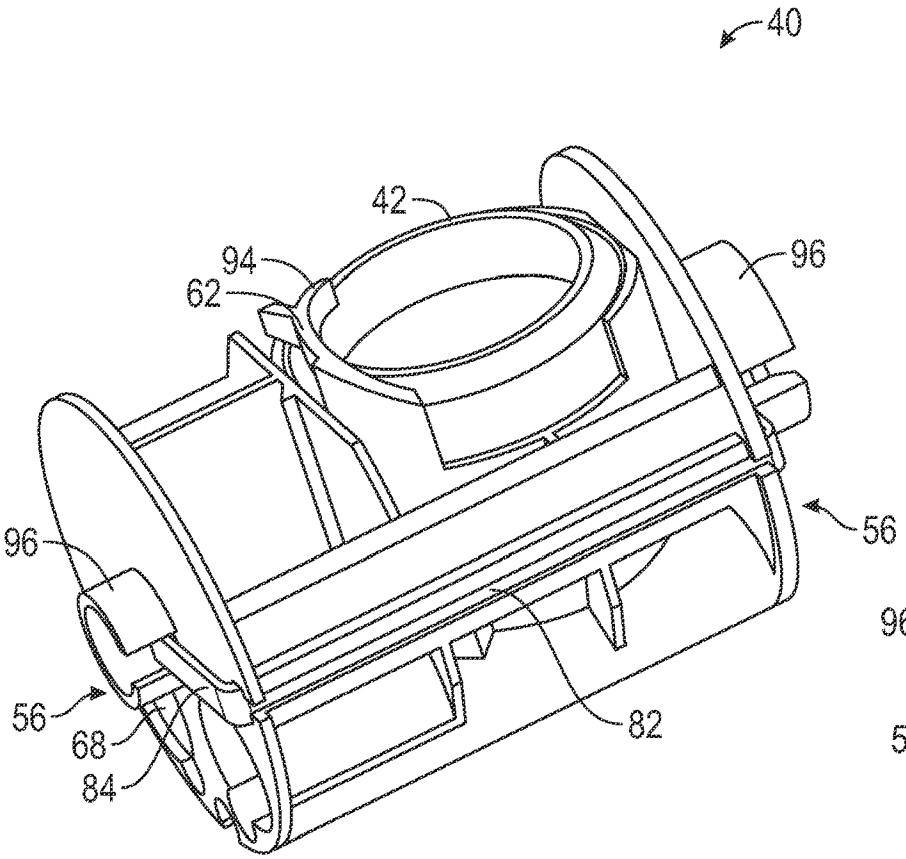
FIG. 16 is an illustration of another example of a perforating gun module which may be selectively combined, according to an embodiment of the disclosure.

Referring generally to FIGS. 16 and 17, another embodiment of modular perforating gun sections 40 is illustrated. In this example, flexible retention members 62 comprise laterally flexible tabs 94 which may be shifted laterally to enable insertion of a shaped charge 44 into the corresponding charge holder 42. The flexible tabs 94 then simply snap laterally back to retain the shaped charge 44. The connection features 56 may comprise a variety of concentric, circular members 96 which may be inserted into each other and held with a suitable snap hook or other type of connection feature.

Figure 19:
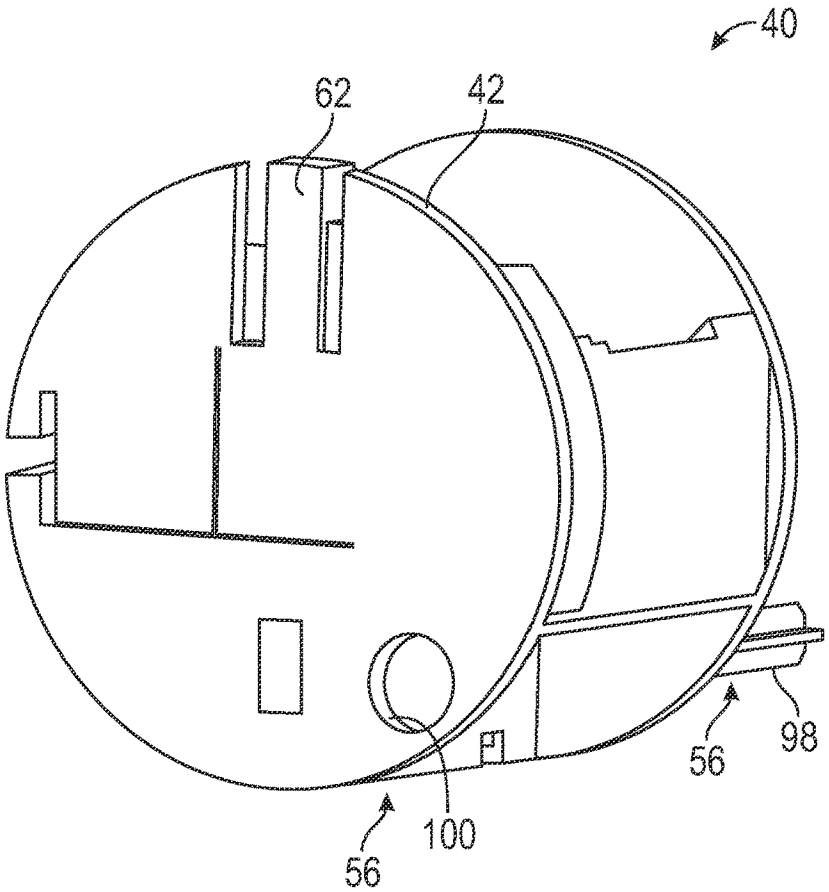
FIG. 19 is an illustration of the perforating gun module of FIG. 18 from a different angle, according to an embodiment of the disclosure.
Figure 18:
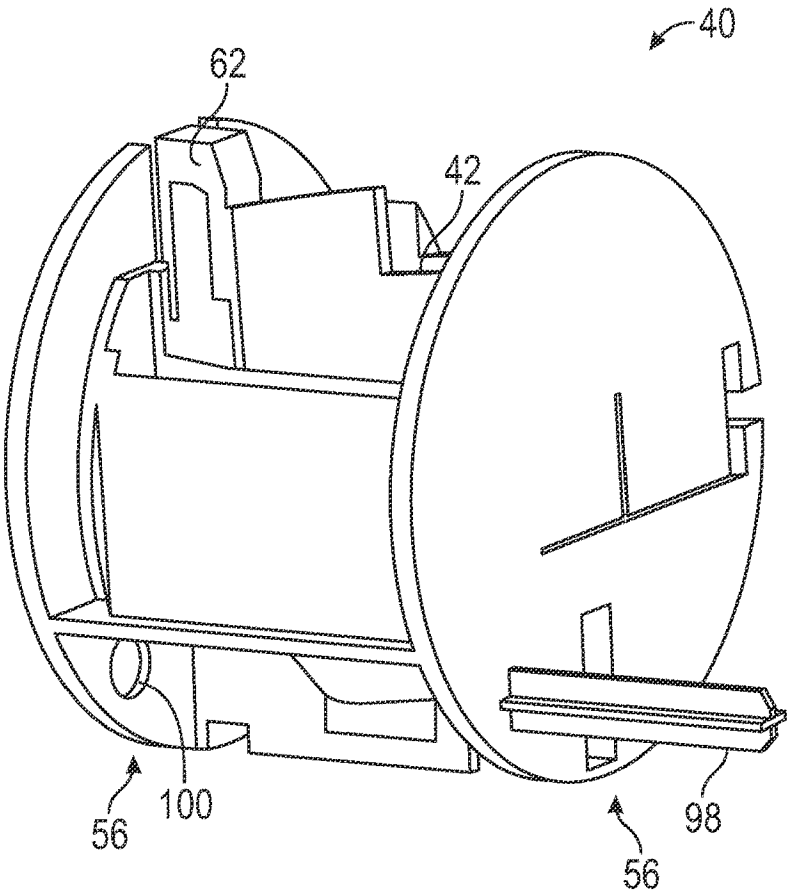
FIG. 18 is an illustration of another example of a perforating gun module which may be selectively combined, according to an embodiment of the disclosure.

Referring generally to FIGS. 18 and 19, another embodiment of modular perforating gun sections 40 is illustrated. In this example, the connection features 56 may comprise a dowel pin 98 which is received in a corresponding pin receiver recess 100 in the next adjacent perforating gun section 40. The dowel pin 98 may be used to orient the perforating gun sections 40, and thus the charge holders 42, with respect to each other along the modular perforating gun sections 40 of the overall perforating gun 36.

Depending on the parameters of a given environment and/or perforating gun operation, the size, configuration, and number of modular perforating gun sections 40 may vary. For example, the number and orientation of perforations into the surrounding formation 34 may dictate the length of the perforating gun 36, the number of perforating gun sections 40, and the shaped charge orientation as well as the adjustability of the orientation. Some perforating guns 36 may be constructed with appropriate switches to enable selective firing of shaped charges 44 along different sections of the overall perforating gun 36 or of separate perforating guns 36 located downhole.

Similarly, various types of connection features 56, conductive features, adjustability features, and/or other features of the modular perforating gun sections 40 may be selected to facilitate the quick, easy and inexpensive assembly of a given perforating gun 36 for a given application. Various connection features 56 may be interchanged with other features of the modular perforating gun sections 40. The modular perforating gun sections 40 also may be injection molded or otherwise inexpensively created from a variety of injection moldable plastics or other suitable materials providing the desired ease of manufacture and selectively configurable structures.

In accordance with certain embodiments, a system for use in a well includes a perforating gun having modular perforating gun sections configured to be snapped together to establish a desired length of the perforating gun. Each modular perforating gun section has at least one charge holder and charge retainer to receive and retain a corresponding shaped charge.

In some embodiments, each modular perforating gun section is formed of plastic. In some embodiments, each modular perforating gun section is injection molded from plastic. In some embodiments, the modular perforating gun sections are configured to be snapped together via connection features. In some embodiments, the connection features maintain respective charge holders of adjacent modular perforating gun sections at desired phasing. In some embodiments, each modular perforating gun section comprises a conductor. The conductors are arranged to form conductive contact when the modular perforating gun sections are snapped together.

In some embodiments, the perforating gun includes a rod extending through the modular perforating gun sections. In some embodiments, selected modular perforating gun sections include a weight to rotate the modular perforating gun sections about the rod to a desired angular orientation. In some embodiments, the modular perforating gun sections are connected to form a loading tube of the perforating gun. In some embodiments, the perforating gun includes a tubular member surrounding the loading tube. In some embodiments, the system includes shaped charges connected via a detonator cord.

In accordance with certain embodiments, a perforating gun includes modular perforating gun sections configured to be snapped together to establish a desired length of the perforating gun. Each perforating gun section has at least one charge holder and charge retainer to receive and retain a corresponding shaped charge.

In some embodiments, each modular perforating gun section is formed of plastic. In some embodiments, each modular perforating gun section is injection molded from plastic. In some embodiments, the modular perforating gun sections are configured to be snapped together via connection features. In some embodiments, each modular perforating gun section comprises a conductor. The conductors are arranged to form conductive contact when the modular perforating gun sections are snapped together.

In accordance with certain embodiments, a method for deploying a perforating gun in a well includes assembling the perforating gun from modular perforating gun sections. A respective section of the modular perforating gun sections are snapped together with a corresponding additional section of the modular perforating gun sections to establish a desired length of the perforating gun. Each respective section of the modular perforating gun sections has at least one charge holder and charge retainer to receive and retain a corresponding shaped charge. The method also includes deploying the perforating gun downhole in the well using a conveyance.

In some embodiments, the perforating gun includes a rod extending through the plurality of modular perforating gun sections. In some embodiments, selected modular perforating gun sections include a weight to rotate the modular perforating gun sections about the rod to a desired angular orientation. In some embodiments, the modular perforating gun sections are connected to form a loading tube of the perforating gun.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a perforating gun having a plurality of modular perforating gun sections configured to be coupled together to establish a desired length of the perforating gun, at least one modular perforating gun section of the plurality of modular perforating gun sections comprising:

a central axis extending along a longitudinal axis of the perforating gun;

a planar first end wall positioned proximate to a first end of the at least one modular perforating gun section;

a planar second end wall positioned proximate to a second end of the at least one modular perforating gun section;

at least one charge holder and charge retainer to receive and retain a corresponding shaped charge;

at least one connector positioned on the first end wall and extending outwardly therefrom along the central axis, the at least one connector including a hook;

at least one opening positioned on the second end wall, the at least one opening configured to receive the at least one connector of an adjacent modular perforating gun section; and at least one protrusion positioned on an interior surface of the second end wall, the at least one protrusion configured to engage the hook of the at least one connector of the adjacent modular perforating gun section.

2. The system as recited in claim 1, wherein each modular perforating gun section is formed of plastic.

3. The system as recited in claim 1, wherein each modular perforating gun section is injection molded from plastic.

4. The system as recited in claim 1, wherein the at least one connector maintains respective charge holders of adjacent modular perforating gun sections at desired phasing.

5. The system as recited in claim 4, wherein each modular perforating gun section comprises a conductor, the conductors being arranged to form conductive contact when the plurality of modular perforating gun sections are coupled together.

6. The system as recited in claim 1, further comprising a rod extending through the plurality of modular perforating gun sections.

7. The system as recited in claim 6, wherein selected modular perforating gun sections of the plurality of modular perforating gun sections each include a weight to rotate the plurality of modular perforating gun sections about the rod to a desired angular orientation.

8. The system as recited in claim 1, wherein the plurality of modular perforating gun sections are connected to form a loading tube of the perforating gun.

9. The system as recited in claim 8, wherein the perforating gun further comprises a tubular member surrounding the loading tube.

10. The system as recited in claim 1, further comprising a plurality of the shaped charges connected to one another via a detonator cord.

11. A perforating gun, comprising:

a plurality of modular perforating gun sections configured to be coupled together to establish a desired length of the perforating gun, each modular perforating gun section of the plurality of modular perforating gun sections comprising:

a central axis extending along a longitudinal axis of the perforating gun;

a plurality of pins positioned at a first end of the modular perforating gun section and extending outwardly therefrom along the central axis;

a central rod member positioned at the first end and extending outwardly therefrom along the central axis;

a plurality of pin recesses positioned at a second end of the modular perforating gun section, the plurality of pin recesses configured to receive the plurality of pins of an adjacent modular perforating gun section;

a central opening positioned at the second end and configured to receive the central rod member of the adjacent modular perforating gun section; and at least one charge holder and charge retainer to receive and retain a corresponding shaped charge.

12. The perforating gun of claim 11, wherein each modular perforating gun section is formed of plastic.

13. The perforating gun of claim 11, wherein each modular perforating gun section is injection molded from plastic.

14. The perforating gun of claim 11, wherein the plurality of pins includes at least four pins and the plurality of recesses includes more than four recesses.

15. The perforating gun of claim 14, wherein each modular perforating gun section comprises a conductor, the conductors being arranged to form conductive contact when the plurality of modular perforating gun sections are coupled together.

16. A method for deploying a perforating gun in a well, comprising:

assembling the perforating gun comprising:

selecting a plurality of modular perforating gun sections to establish a desired length of the perforating gun, each of the plurality of modular perforating gun sections having a central axis, a connector positioned on a planar first end wall and protruding outwardly therefrom along the central axis, an opening positioned on a planar second end wall, and at least one charge holder and charge retainer to receive and retain a corresponding shaped charge, positioning the first end wall of a first modular perforating gun section of the plurality of modular perforating gun sections proximate to the second end wall of a second modular perforating gun section of the plurality of modular perforating gun sections, aligning the connector of the first modular perforating gun section with the opening positioned on the second end wall of the second modular perforating gun section, moving the first modular perforating gun section toward the second modular perforating gun section along the central axis until the connector of the first modular perforating gun section is received within the opening of the second modular perforating gun section, wherein the connector includes a hook that engages a protrusion positioned on an interior surface of the second end wall, thereby coupling the first modular perforating gun section and the second modular perforating gun section together; and deploying the perforating gun downhole in the well using a conveyance.

17. The method of claim 16, wherein the perforating gun further comprises a rod extending through the plurality of modular perforating gun sections.

18. The method of claim 17, wherein selected modular perforating gun sections of the plurality of modular perforating gun sections each include a weight to rotate the plurality of modular perforating gun sections about the rod to a desired angular orientation.

19. The method of claim 16, wherein the plurality of modular perforating gun sections are connected to form a loading tube of the perforating gun.

* * * * *